United States Patent [19]

Howe

[11] Patent Number: 4,966,085

[45] Date of Patent: Oct. 30, 1990

[54] FOLDING FREIGHT CARRIER

[76] Inventor: Peter Howe, 24, Headroomgate Road, St. Annes-on-Sea, Lancashire, England

[21] Appl. No.: 418,761

[22] Filed: Oct. 6, 1989

Related U.S. Application Data

[63] Continuation of Ser. No. 320,840, Mar. 9, 1989, abandoned, which is a continuation of Ser. No. 222,389, Jul. 21, 1988, abandoned, which is a continuation of Ser. No. 102,743, Sep. 24, 1987, abandoned, which is a continuation of Ser. No. 841,043, Mar. 14, 1986, abandoned, which is a continuation of Ser. No. 576,177, Feb. 3, 1984, abandoned, which is a continuation of Ser. No. 507,536, Jun. 24, 1983, abandoned, which is a continuation of Ser. No. 196,065, Oct. 10, 1980, abandoned.

[30] Foreign Application Priority Data

Oct. 16, 1979 [GB] United Kingdom ..... 7935920

[51] Int. Cl.[5] ..... B61D 17/06; B65D 19/00

[52] U.S. Cl. ..... 108/55.1; 108/56.1

[58] Field of Search ..... 108/55.1, 56.1, 132; 220/1.5, 6; 248/346; 206/600

[56] References Cited

U.S. PATENT DOCUMENTS

| | | | |
|---|---|---|---|
| 2,471,693 | 5/1949 | Lilienfeld | 108/55.1 |
| 3,874,546 | 4/1975 | Sanders et al. | 220/6 |
| 4,240,359 | 12/1980 | Howe | 108/56.1 |

FOREIGN PATENT DOCUMENTS

| | | | |
|---|---|---|---|
| 1470278 | 1/1967 | France | 108/55.1 |
| 1222861 | 2/1971 | United Kingdom | 108/56.1 |

*Primary Examiner*—Peter R. Brown

*Attorney, Agent, or Firm*—Armstrong, Nikaido, Marmelstein, Kubovcik & Murray

[57] ABSTRACT

A folding freight carrier consists of a flat rectangular base structure, whose upper surface forms a loading bearing freight carrying platform, having post members pivotally mounted on the base structure at each corner thereof, said post members are capable of being moved from an erected position in which the post extends upwardly from the base structure to a folded position in which the post members lie parallel to the base structure. The base structure is provided adjacent its corners with recesses into which the post members are located when in their folded position so that the post members do not project above the freight carrying platform but rather form a continuation of the load bearing freight carrying platform.

3 Claims, 3 Drawing Sheets

FOLDING FREIGHT CARRIER

This application is a continuation of application Ser. No. 320,840 filed Mar. 9, 1989; which is a continuation of Ser. No. 222,389, filed July 21, 1988; which is a continuation of Ser. No. 102,743, filed Sept. 24, 1987; which is a continuation of Ser. No. 841,043, filed Mar. 14, 1986; which is a continuation of Ser. No. 576,177, filed Feb. 3, 1984; which is a continuation of Ser. No. 507,536, filed June 24, 1983; which is a continuation of Ser. No. 196,065, filed Oct. 10, 1980 all now abandoned.

This invention relates to folding freight carriers or containers of the type usually known as cargo flats and more particularly, but not exclusively, to the type of freight carrier described in British Pat. Nos.: 1,217,334; 1,252,000; 1,266,689; 1,432,542 and U.S. Pat. No. 4,240,356 patent application No: 21474/77.

This type of freight carrier comprises a substantially flat rectangular base structure, forming a load-bearing freight carrying platform having a post member at each corner thereof which is pivotally mounted on the base structure. Each post member is capable of being moved between a folded position in which the post rests upon and lies parallel to and adjacent to the base structure, and an erected position in which the post extends upwardly from the base structure.

When the posts are in their erected position, one or more cross members can be connected therebetween to form side and end members of the carrier and in certain types of carrier, the two posts at each end of the base structure are permanently connected together by one or more cross members to form a unitary end structure. With the posts erected and the sides and ends thereof in position, the carrier forms an enclosure or container for freight or cargo which is loaded on to the upper surface of the base structure. It is usual to provide an arrangement for locking the corner posts in their erected position and two alternative types of locking arrangements are described in British Pat. No.: 1,217,334 and British patent application No.: 21474/77.

When the carrier is empty and the corner posts are in their folded position, one or more carriers can be stacked one upon another to save space when empty carriers are being transported. It is usual to provide an interlocking arrangement on each freight carrier for connecting the folded carrier to a similar folded carrier which is stacked thereon. Such interlocking arrangements are described in British Pat. No.: 1,252,000 and British patent application No.: 21474/77.

Furthermore, when forming such a stack of folded freight carriers, it is necessary for the overall height of the stack to remain within the height of an erected carrier so as to conform to and fall within the normal space allocated in rail or road vehicles or ships which are used for transporting such freight carriers or containers.

In the known folding freight carriers referred to above, the corner posts or unitary end structures rest in their folded position upon the upper surface of the base structure. Consequently, when a similar loaded freight carrier is placed thereon to form a stack, this results in the disadvantage that the space occupied by the corner posts or unitary end structures can reduce the number of folded freight carriers which it is possible to form into a stack whose overall height remains within the height of an erected carrier.

In addition, there is often a requirement when transporting certain types of freight to provide a plain load-carrying platform or bolster. Clearly, in the known types of folding freight carriers referred to above, the corner posts or unitary end structures, which in their folded positions rest upon the freight-carrying platform, make it difficult, if not impossible, to utilise a folded freight carrier as a bolster, and the object of this invention is to provide a folding freight carrier in which the above disadvantage and difficulty are alleviated.

According to this invention, a folding freight carrier comprises a base structure having an upper surface forming a load bearing freight carrying platform, and post members at or adjacent to each corner of the base structure which are pivotally mounted thereon so as to be capable of being selectively pivoted from an erect upright position to a folded position in which each post member lies parallel to or substantially parallel to the base structure; wherein each post member in the folded position does not project above the upper surface of the base structure.

Preferably, each post member in the folded position lies flush with and forms a continuation of the upper surface of the base structure so as to constitute therewith, the load bearing freight carrying platform. Preferably, also, the sides of the base structure adjacent to each corner have a recess formed therein in each of which the associated post member is received when in the folded position.

The two post members at each end of the base structure are, preferably, connected together by one or more cross members to form a unitary end structure and the upper surface of the base structure is provided with one or more corresponding recesses therein in which the or each associated cross member is located when the end structure is in the folded position so that the or each cross member does not project above said upper surface of the base structure.

Preferably, the lower end of each post member is provided with an attachment or engaging means whereby, when the posts are in their folded position, said attachment or engaging means is capable of being connected to a lifting apparatus to effect lifting and transportation of the folded carrier in either an unloaded or loaded condition. Preferably, also, the pivotal axis of each post member is disposed adjacent to the lower end thereof but is spaced-apart from the position of the attachment or engaging means in a direction towards the free upper end of the post member and/or is off-set from the longitudinal axis of the erected post member in a direction inwardly along the longitudinal axis of the base structure, so that when the carrier is lifted with the post members in their folded position by utilisation of the attachment or engaging means on each post member, the lifting force exerted thereon urges the post members towards their folded position.

The base structure preferably has supports formed or mounted therein which are adapted to engage the post members at points spaced-apart from the pivotal axes thereof so as to support the post members in their folded condition and enable the post members or the unitary end structures of which the post members form a part to have a load bearing capability.

A preferred embodiment of this invention will now be described, by way of example only, with reference to the accompanying drawings of which:

Figure 1:
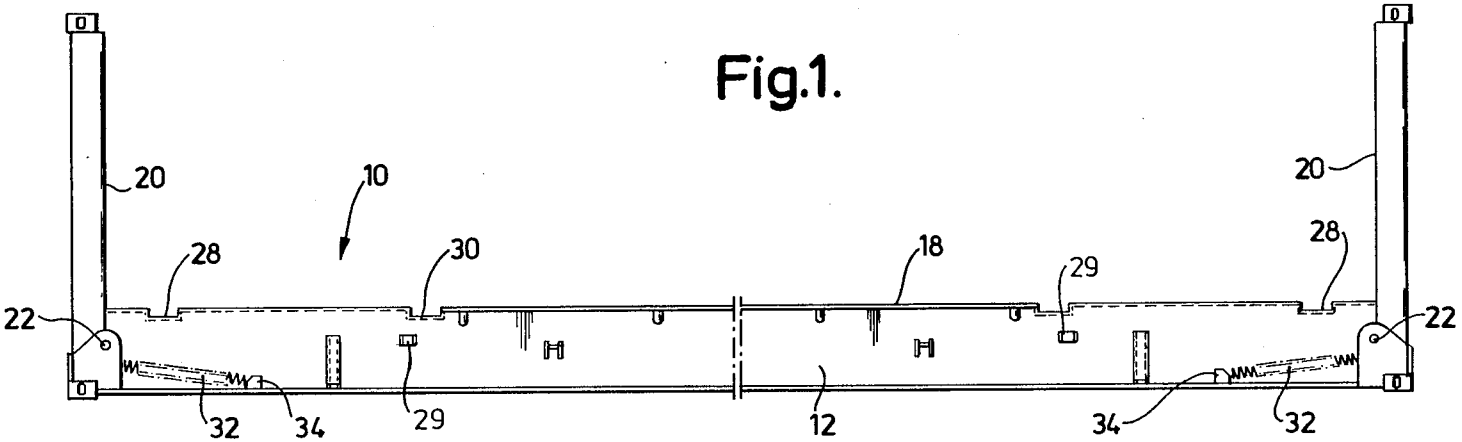
FIG. 1 is a side elevation of a folding freight carrier in an erected position.

Referring now to the drawings, a folding freight carrier or container of the type usually known as a folding cargo flat comprises a substantially flat rectangular base structure indicated generally at 10. The base structure 10 is formed of two parallel spaced-apart longitudinally extending beams 12, one beam 12 being disposed adjacent to each side of the base structure. Two spaced-apart parallel longitudinally extending intermediate beams 14 are disposed between the two beams 12 and a series of parallel spaced-apart transversely extending beams 16 are welded to the beams 12 and the intermediate beams 14. The upper surface of the base structure 10 is covered with decking formed of, for example, hardwood planking to form a load bearing freight carrying platform 18.

Figure 2:
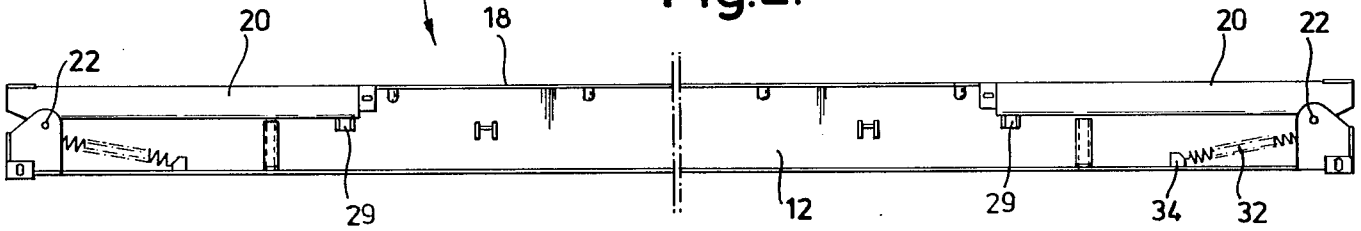
FIG. 2 is a side elevation of the carrier in a folded position.
Figure 3:
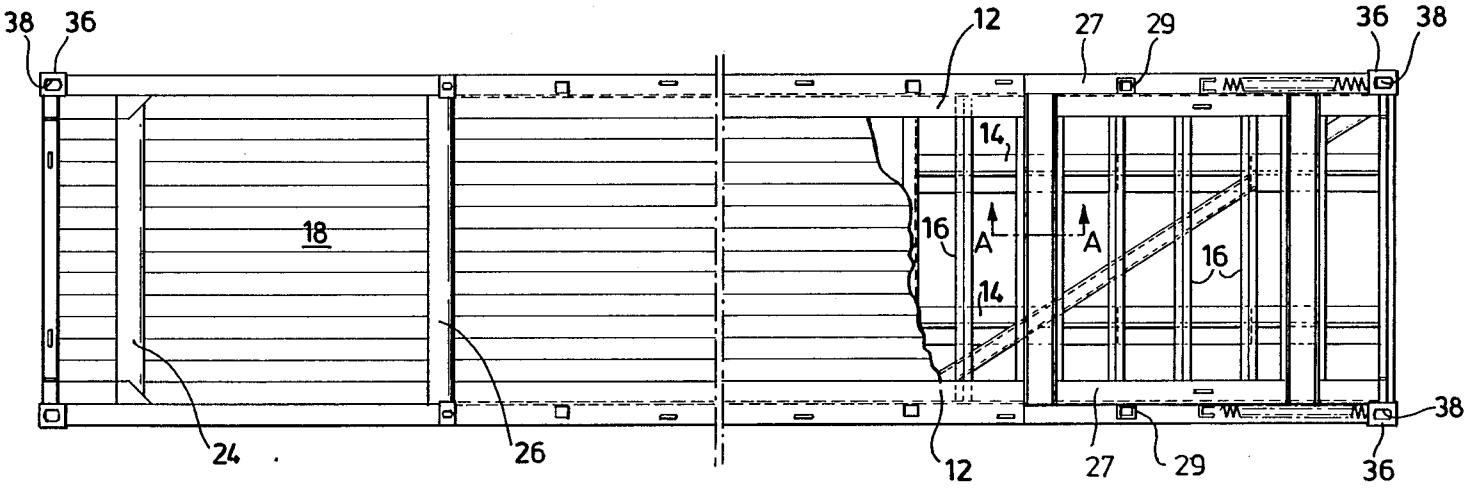
FIG. 3 is a partly sectioned plan view of the carrier shown in FIG. 2 of the drawings.
Figure 5:
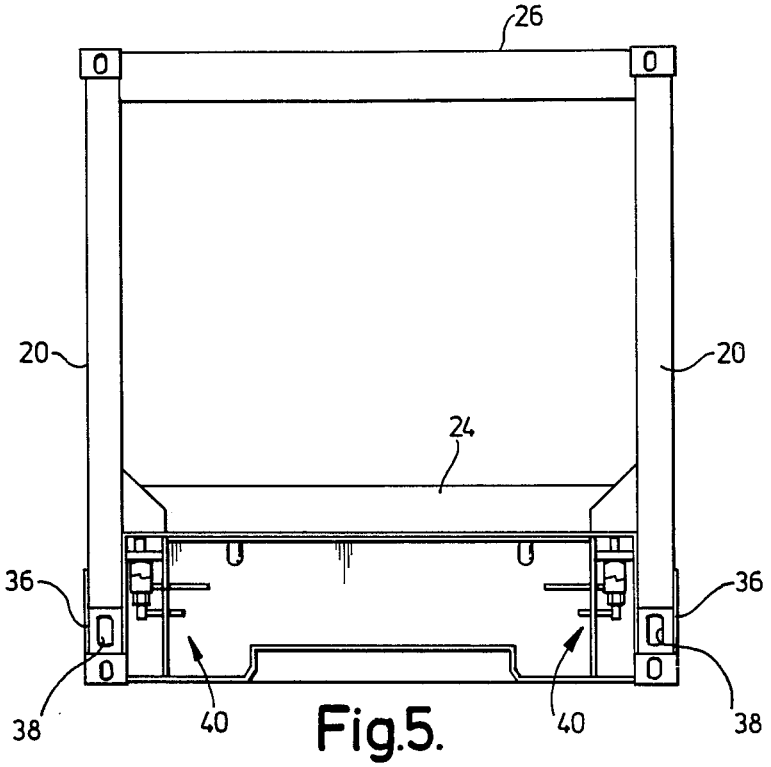
FIG. 5 is an end elevation of the carrier shown in FIG. 1 of the drawings.

A post member 20 is pivotally mounted on the base structure 10 at each corner thereof by means of a pivot pin 22 and each post member 20 is capable of being moved from an erect upright position as shown in FIG. 1 of the drawings to a folded position as shown in FIG. 2 of the drawings. The two post members 20 at each end of the carrier are permanently connected together at a point between their ends by a cross member 24 and at a point adjacent to their free ends by a head rail 26. The two post members 20 at each end of the carrier together with the interconnecting cross member 24 and the interconnecting head rail 26 thus form a unitary end structure which is capable of pivotal movement from the erect position shown in FIG. 1 and FIG. 5 of the drawings to the collapsed position shown in FIG. 2 and FIG. 3 of the drawings.

Figure 4:
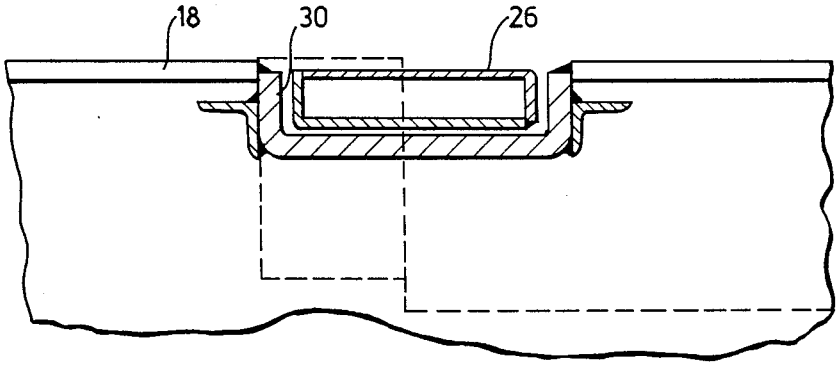
FIG. 4 is a section on the line A—A in FIG. 3 of the drawings.

Each side of the base structure 10 is provided adjacent to the ends thereof with a longitudinally extending recess 27 for receiving the associated post member 20 when the unitary end structure of which the post members 20 form a part is moved to the folded position. Supports 29 are mounted on the base structure 10 adjacent to each recess 27 and are arranged to engage the post members 20 at a point spaced-apart from the pivotal axes thereof so as to support the post members 20 in their folded position and enable the folded post members 20 to have a load bearing capability. The freight carrying platform 18 of the base structure 10 is also provided adjacent to each end thereof with transversely extending recesses 28 and 30 which are adapted to respectively receive therein the cross member 24 and the head rail 26 when the associated unitary end structure, of which they form a part, is moved to the folded position. The disposition of one of the head rails 26 within an associated one of the recesses 30 in the load carrying platform 18 is shown in cross section in FIG. 4 of the drawings.

The pivot pins 22 which pivotally connect the post members 20 to the base structure 10 are disposed sufficiently below the level of the platform 18 of the base structure so that when the unitary end structures are moved to the folded position, the upper surfaces of the post members 20, the cross members 24 and the head rails 26 which together constitute the unitary end structures lie substantially flush with and do not project above the surface of the platform 18. It will therefore be appreciated that when the carrier is in the folded position, the unitary end structures formed by the post members 20, the cross members 24 and the head rails 26 form a continuation of the load bearing freight carrying platform 18.

The pivot pins 22 are also spaced-apart from the lower end of the associated post members 20 and a helical coil tension spring 32 is connected between the lower end of each post member 20 and a lug 34 on the base structure 10 of the carrier. Each spring 32 is arranged to be extended in length as the associated post members 20, cross members 24 and head rails 26 are pivoted downwardly from the erect to the folded position. The springs 32 exert a force on the unitary end structure which urges said unitary end structure towards the erect position thus counterbalancing at least part of the weight thereof. The lower end of each post member 20 is provided with a plate 36 having an aperture 38 formed therein. The plate 36 is disposed on the associated post member 20 so that when said post member is in the folded position, the plate 36 is positioned at each corner of the carrier and the aperture 38 therein provides an attachment or engaging means for connecting the carrier to a lifting apparatus such as a spreader frame of a crane which can be utilised to effect lifting and transportation of the folded carrier in either an unloaded or loaded condition.

A locking apparatus indicated generally at 40 is provided at each corner of the base structure 10. This locking apparatus is of the type described in U.S. Pat. No. 4,240,359 and is arranged to perform the dual function of locking the associated post members 20 and thus the unitary end structures of which they form a part, in their erect upright position and also when the unitary end structures are in their folded position, the locking apparatus 40 being arranged to interlock the folded carrier with a similar folded freight carrier which is disposed thereon.

It will be appreciated that a stack of folded freight carriers can thus be formed and it will also be appreciated that the disposition of the post members 20, the cross members 24 and the head rails 26 in their folded position so that the unitary end structure which they constitute lies flush with and does not extend above the surface of the freight carrying platform 18 enables a larger number of folded freight carriers to be formed into a stack of given height than would be possible if the unitary end structures in their folded position merely rested upon the freight carrying platform 18.

In a modification, the cross member 24 and the head rail 26 are arranged to be removable from the associated post members 20 and the recesses 28 and 30 in the freight carrying platform 18 of the base structure 10 are not required.

In addition, the cross members or head rails which are releasably connectable to the post members 20 can be dispensed with entirely and the base structure merely provided with free standing pivotable post members 20 at each corner thereof. This form of construction allows unobstructed access when loading the freight carrying platform 18 from not only the sides but also the ends thereof.

It will also be appreciated that the folding carrier which is the subject of this invention can perform the dual functions of not only providing a container within which freight can be carried but can also be utilised as a pure load carrying platform or bolster when the post members 20 are disposed in their folded position so that freight to be transported is merely placed upon the platform 18 of the base structure 10 of the carrier.

I claim:

1. A folding freight carrier comprising: a base structure having a substantially plane continuous upper surface forming a load bearing freight carrying platform; post members at or closely adjacent to each corner of the base structure which are pivotally mounted thereon so as to be capable of being selectively pivoted from an erect upwardly extending, upright position to a folded position in which each post member lies parallel to, or substantially parallel to, the base structure, the continuous plane load bearing freight carrying platform extending between the two post members at each end of the carrier; means attached to the lower end of each post member and the base for urging each post into the erect upwardly extending upright position; each post member in the folded position being disposed so as not to project above the upper surface of the base structure and forming together with the existing upper surface an uninterrupted, solid continuous plane load bearing freight carrying platform extending across substantially the full width and length of the freight carrier; each of the sides of the base structure adjacent to each corner having an elongated recess formed therein in each of which the associated post member is entirely received when in the folded position, there further being separated support means within each said elongated recess, said support means being positioned above the bottom of the base structure, for supporting the associated post member in its folded position and enabling the post member to have a load bearing capability; the two post members at each end of the base structure being connected together by at least one cross member to form a unitary end structure, the upper surface of the base structure being provided with at least one cross corresponding recess therein in which the associated cross member is located when the end structure is in the folded position so that each cross member does not project above said upper surface of the base structure; the lower end of each post member being provided with an attachment means whereby, when the posts are in their folded position, said attachment means are capable of being connected to a lifting apparatus to effect lifting and transportation of the folded carrier; and wherein the pivotal axis of each post member is disposed adjacent to the lower end thereof but spaced apart from the position of the attachment means in a direction towards the free upper end of the post member, so that when the carrier is lifted with the post members in their folded position by utilization of the attachment means on each post member, the lifting force exerted thereon urges the post members toward their folded position.

2. A folding freight carrier according to claim 1 wherein said urging means lie entirely within the plane of the base structure, in all dispositions of each post member, from the folded position to the erect upwardly extending upright positions.

3. A folding freight carrier according to claim 1 wherein the depth of said corresponding recess is less than one quarter the overall thickness of said base structure.

* * * * *